US006861929B2

(12) United States Patent
Tsunoda et al.

(10) Patent No.: US 6,861,929 B2
(45) Date of Patent: Mar. 1, 2005

(54) LOW-PASS FILTER

(75) Inventors: Kikuo Tsunoda, Mishima-gun (JP); Masamichi Ando, Kyoto (JP); Yasunori Takei, Kyoto (JP)

(73) Assignee: Murata Manufacturing Co., Ltd. (JP)

( * ) Notice: Subject to any disclaimer, the term of this patent is extended or adjusted under 35 U.S.C. 154(b) by 63 days.

(21) Appl. No.: 10/320,922

(22) Filed: Dec. 17, 2002

(65) Prior Publication Data

US 2003/0112101 A1 Jun. 19, 2003

(30) Foreign Application Priority Data

Dec. 18, 2001 (JP) ..... 2001-384880

(51) Int. Cl.[7] ..... H01P 3/06
(52) U.S. Cl. ..... 333/206; 333/202; 333/207
(58) Field of Search ..... 333/206, 207, 333/202, 203

(56) References Cited

U.S. PATENT DOCUMENTS

| | | | | | |
|---|---|---|---|---|---|
| 2,491,681 | A | * | 12/1949 | Minter | 333/168 |
| 2,569,667 | A | * | 10/1951 | Harvey et al. | 333/202 |
| 2,752,577 | A | | 6/1956 | Polk | |
| 2,896,178 | A | * | 7/1959 | Gordon | 333/206 |
| 3,879,690 | A | * | 4/1975 | Golant et al. | 333/204 |
| 4,161,704 | A | | 7/1979 | Schafer | |
| 4,506,241 | A | * | 3/1985 | Makimoto et al. | 333/222 |
| 4,985,690 | A | * | 1/1991 | Eguchi et al. | 333/222 |
| 6,222,500 | B1 | * | 4/2001 | Koitsalu et al. | 343/864 |
| 6,255,920 | B1 | * | 7/2001 | Ohwada et al. | 333/206 |

FOREIGN PATENT DOCUMENTS

| | | |
|---|---|---|
| DE | 1 264 636 | 3/1968 |
| JP | 56-61801 | 5/1981 |
| JP | 56-076602 | 6/1981 |
| JP | 8-018305 | 1/1996 |
| JP | 10-209704 | 8/1998 |

OTHER PUBLICATIONS

European Search Report dated Aug. 29, 2003.

* cited by examiner

*Primary Examiner*—Robert Pascal
*Assistant Examiner*—Kimberly Glenn
(74) *Attorney, Agent, or Firm*—Dickstein, Shapiro, Morin & Oshinsky, LLP

(57) ABSTRACT

A plurality of cylindrical inner conductor portions having different diameters are connected with each other to form an inner conductor. The inner conductor portions include high-impedance portions and low-impedance portions. The inner conductor is formed within an outer conductor with a nonuniform inner diameter. The inner conductor is formed so that the axial length of some of the inner conductor portions forming the high-impedance portions is smaller than the axial length of the other inner conductor portions forming the high-impedance portions, and the diameter of the inner conductor portions forming the high-impedance portions is greater than a predetermined minimum diameter.

14 Claims, 7 Drawing Sheets

LOW-PASS FILTER

BACKGROUND OF THE INVENTION

1. Field of the Invention

The present invention relates to a coaxial-line low-pass filter for use in a high-frequency transmission circuit.

2. Description of the Related Art

A coaxial-line low-pass filter in the related art is described below with reference to FIG. 7.

FIG. 7 is a side cross-sectional view partially showing the low-pass filter taken along a plane which is parallel to the signal propagation direction and which includes the central axis of an inner conductor.

The low-pass filter shown in FIG. 7 includes a tubular outer conductor 7 with a substantially uniform inner diameter, an input/output unit 10, and an inner conductor formed of high-impedance portions 701 and low-impedance portions 702.

In FIG. 7, len701 indicates the length (axial length) of the high-impedance portion 701 of the inner conductor in the signal propagation direction; len702 indicates the length (axial length) of the low-impedance portion 702 of the inner conductor in the signal propagation direction; w701 indicates the diameter (axial diameter) of a plane of the high-impedance portion 701 of the inner conductor which is vertical to the signal propagation direction; w702 indicates the diameter (axial diameter) of a plane of the low-impedance portion 702 of the inner conductor which is vertical to the signal propagation direction; Z indicates input impedance of the low-pass filter; $Z_{hi}$ indicates characteristic impedance of the high-impedance portion; and $Z_{low}$ indicates characteristic impedance of the low-impedance portion.

The inner conductor comprises a plurality of cylindrical members formed of a predetermined number of high-impedance portions 701 and a predetermined number of low-impedance portions 702 which are alternately connected with each other. The high-impedance portions 701 and the low-impedance portions 702 of the inner conductor are connected with each other so that the central axes of the high- and low-impedance portions 701 and 702 are aligned in a line. The inner conductor is placed in the outer conductor 7 so that the central axis of the inner conductor matches the central axis of the outer conductor 7.

The high-impedance portions 701 of the inner conductor have the same length (axial length) len701, and the same width (axial diameter) w701, thus allowing characteristic impedance $Z_{hi}$ to be constant thereacross. Likewise, the low-impedance portions 702 of the inner conductor have the same length (axial length) len702, and the same width (axial diameter) w702, thus allowing characteristic impedance $Z_{low}$ to be constant thereacross.

The input/output unit 10 having input impedance Z is connected to the high-impedance portion 701 at an end of the inner conductor.

The high-impedance portions 701 function as inductors, while the low-impedance portions 702 function as capacitors. A low-pass filter including a plurality of LC resonator circuits connected in series is thus achieved.

Such a low-pass filter in the related art has problems.

In the low-pass filter shown in FIG. 7 in which the inner diameter of the outer conductor 7 is uniform, resonance of one-half wavelength of a transmission signal is produced in the high-impedance portions 701 of the inner conductor which has a smaller axial diameter. This causes spurious resonance peaks in the attenuation region of the low-pass filter, resulting in an undesired attenuation characteristic. If a plurality of high-impedance portions having the same axial length and the same axial diameter are used to form the filter, the positions of spurious resonance peaks in the high-impedance portions coincide with each other, thus causing overlapping spurious responses to induce higher spurious resonance peaks.

In order to reduce such spurious resonance, a low-pass filter has been proposed in which high-impedance portions have different axial lengths and axial diameters. Specifically, different axial lengths and widths of the high-impedance portions allow spurious resonance peaks to be produced at different frequencies in the high-impedance portions so as to disperse spurious resonance peaks. This mechanism prevents overlapping spurious resonance peaks, which does not affect an attenuation characteristic.

In such a low-pass filter, if the high-impedance portions have different axial lengths while maintaining constant characteristic impedance, the axial diameters of the high-impedance portions must differ from each other in the case where the inner diameter of the outer conductor is uniform. That is, the axial diameter of a high-impedance portion must be reduced in order to make the axial length thereof shorter, and the axial diameter of a high-impedance portion must be increased in order to make the axial length thereof longer. This does not cause a problem if the length of the low-pass filter can be freely designed. However, if the length of the low-pass filter is restricted, the filter has a mixture of a high-impedance portion with small axial diameter and a high-impedance portion with great axial diameter.

Typically, a lathe or the like is used to cut a material having a certain thickness into the shape of an inner conductor of a low-pass filter.

Thus, an inner conductor having too small an axial diameter would be off-centered during a cutting process, and is difficult to cut, thus increasing the production cost or causing defective products. A finished inner conductor would also have lower resistance to vibration or shock.

For example, in a multistage low-pass filter in which the length between input/output units at both ends thereof is 100 mm, and the diameter of a low-impedance portion is about 20 mm, the diameter of a high-impedance portion must be 2 mm or greater in order to facilitate the cutting process for the inner conductor. With the structure of the above-described low-pass filter, however, the width of a high-impedance portion can be less than 2 mm in design.

SUMMARY OF THE INVENTION

Accordingly, it is an object of the present invention to provide a low-pass filter with high anti-vibration and anti-shock properties which can be produced with ease while suppressing an influence of spurious resonance peaks.

A low-pass filter includes an outer conductor having a predetermined shape in a cross section vertical to a signal propagation direction; an inner conductor formed within the outer conductor, including a plurality of low-impedance portions and a plurality of high-impedance portions in an alternate manner; and an input/output unit connected to an end of the inner conductor, wherein the cross section of the outer conductor vertical to the signal propagation direction is nonuniform in the signal propagation direction.

This structure allows the high-impedance portions and the low-impedance portions in the inner conductor to be different from one another in length in the signal propagation direction, and in shape or area of a plane vertical to the signal propagation direction. A low-pass filter having high anti-vibration and anti-shock properties in which an influence of spurious resonance is suppressed is achieved.

A predetermined high-impedance portion of the plurality of high-impedance portions in the inner conductor may be different from the other high-impedance portions in shape or area of a plane vertical to the signal propagation direction and in length in the signal propagation direction, thereby preventing coincidence of the spurious resonance frequencies.

A predetermined low-impedance portion of the plurality of low-impedance portions in the inner conductor may be different from the other low-impedance portions in shape or area of a plane vertical to the signal propagation direction and in length in the signal propagation direction, thereby preventing coincidence of the spurious resonance frequencies.

The outer conductor may be tapered so that the interior surface of the outer conductor does not extend parallel to the signal propagation direction. Therefore, the high-impedance portions have different diameters and axial lengths, thereby preventing coincidence of the spurious resonance frequencies. The outer conductor can also be used as a die-pulling taper, thus reducing the production cost.

The outer conductor may be shaped so that the interior surface of the outer conductor extends in a curved manner relative to the signal propagation direction. Therefore, the high-impedance portions have different diameters and axial lengths, thereby preventing coincidence of the spurious resonance frequencies. The outer conductor can also be used as a die-pulling taper, thus reducing the production cost.

The outer conductor may include a portion in which the inner diameter of the outer conductor is nonuniform in the signal propagation direction. Therefore, a low-pass filter having a great axial length would achieve efficient dispersion of the spurious resonance frequencies.

The outer conductor may be shaped so that the interior surface of the outer conductor is formed of a plurality of curves, and at least one straight portion connecting the curves with each other. Therefore, the high-impedance portions have different diameters and axial lengths, thereby preventing coincidence of the spurious resonance frequencies. In addition, the outer conductor can be shaped more freely, thus achieving predetermined characteristics.

DESCRIPTION OF THE PREFERRED EMBODIMENTS

A low-pass filter according to a first embodiment of the present invention is now described with reference to FIG. 1.

Figure 1:
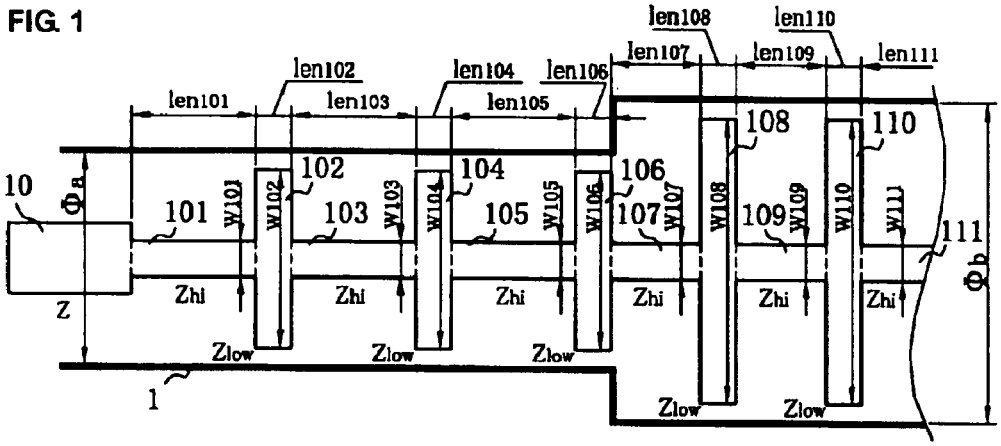
FIG. 1 is a side cross-sectional view of a low-pass filter according to a first embodiment of the present invention.

FIG. 1 is a side cross-sectional view of a low-pass filter according to the first embodiment.

The low-pass filter shown in FIG. 1 includes a tubular outer conductor 1, an input/output unit 10, and an inner conductor formed within the outer conductor 1. The inner conductor is formed of a plurality of cylindrical inner conductor portions 101 to 111.

In FIG. 1, Z indicates input impedance of the input/output unit 10; $Z_{hi}$ indicates characteristic impedance of the inner conductor portions 101, 103, 105, 107, 109, and 111; $Z_{low}$ indicates characteristic impedance of the inner conductor portions 102, 104, 106, 108, and 110; len101 to len111 indicate the axial length of the inner conductor portions 101 to 111; w101 to w111 indicate the axial diameter of the inner conductor portions 101 to 111; and $\Phi_a$ and $\Phi_b$ indicate the inner diameter of the outer conductor 1.

The inner conductor is configured such that the inner conductor portions 101, 103, 105, 107, 109, and 111, and the inner conductor portions 102, 104, 106, 108, and 110 are alternately connected with each other. The diameter of the inner conductor portions 101, 103, 105, 107, 109, and 111 is preferably different from the diameter of the inner conductor portions 102, 104, 106, 108, and 110. The inner conductor is preferably configured so that the central axes of the inner conductor portions 101 to 111 are aligned. The inner conductor is preferably placed in the outer conductor 1 so that the central axis of the inner conductor matches the central axis of the outer conductor 1. The axial diameters w101, w103, w105, w107, w109, and w111 of the inner conductor portions 101, 103, 105, 107, 109, and 111 are preferably smaller than the axial diameters w102, w104, w106, w108, and w110 of the inner conductor portions 102, 104, 106, 108, and 110.

This structure allows characteristic impedance $Z_{hi}$ of the inner conductor portions 101, 103, 105, 107, 109, and 111 to be higher than characteristic impedance $Z_{low}$ of the inner conductor portions 102, 104, 106, 108, and 110 adjacent thereto. Thus, the inner conductor portions 101, 103, 105, 107, 109, and 111 form high-impedance portions, and the inner conductor portions 102, 104, 106, 108, and 110 form low-impedance portions. The high-impedance portions are equivalent to inductors, while the low-impedance portions are equivalent to capacitors. A low-pass filter including multistage LC circuits formed of inductors as series elements and capacitors as parallel elements is thus achieved.

The axial lengths len107 and len109 of the inner conductor portions 107 and 109 are preferably smaller than the axial lengths len101, len103, and len105 of the inner conductor portions 101, 103, and 105.

The interior surface of the outer conductor 1 extends in parallel to the signal transmission direction, and the inner diameter of the outer conductor 1 is nonuniform. Specifically, as shown in FIG. 1, the inner diameter $\Phi_a$ in a section extending from the end connected to the input/output unit 10 to the inner conductor portion 106 is different from the inner diameter $\Phi_b$ in a portion extending from the inner conductor portion 107 to the other end connected to the other input/output unit (not shown). Preferably, $\Phi_b > \Phi_a$.

The relationship between the axial lengths and the impedances of the inner conductor portions 101 to 111 is described below.

The relationship between the axial lengths len101 to len111 and the impedances $Z_{hi}$ and $Z_{low}$ of the inner conductor portions 101 to 111 is preferably given by the following expressions:

$$\omega_1 L_1 = Z_{hi}\sin\left(\frac{\omega_i len_1}{v_{hi}}\right) + Z_{low}\frac{\omega_1 len_2}{2v_{low}} \quad (1)$$

$$\omega_1 L_3 = Z_{hi}\sin\left(\frac{\omega_i len_3}{v_{hi}}\right) + Z_{low}\frac{\omega_1 len_2}{2v_{low}} + Z_{low}\frac{\omega_1 len_4}{2v_{low}} \quad (2)$$

$$\omega_1 L_n = Z_{hi}\sin\left(\frac{\omega_1 len_n}{v_{hi}}\right) + Z_{low}\frac{\omega_1 len_{n-1}}{2v_{low}} + Z_{low}\frac{\omega_1 len_{n+1}}{2v_{low}} \quad (3)$$

where $\omega_1$ denotes the angular frequency of the cut-off frequency, $L_1$ denotes the inductance of the inner conductor portion 101, $L_3$ denotes the inductance of the inner conductor portion 103, $v_{hi}$ denotes the signal propagation velocity in the high-impedance portions, and $v_{low}$ denotes the signal propagation velocity in the low-impedance portions.

$L_n$ indicates the inductance of inner conductor portion n, where n is an odd number.

Substituting $v_{hi}=v_{low}=C$ (velocity of light) into equations (1), (2), and (3), subjected to approximation, then, the inductances of the inner conductor portions 101, 103, and n are determined as follows:

$$L_1 = \frac{Z_{hi} len_1}{C} + \frac{Z_{low} len_2}{2C} \quad (4)$$

$$L_3 = \frac{Z_{hi} len_3}{C} + \frac{Z_{low} len_2}{2C} + \frac{Z_{low} len_4}{2C} \quad (5)$$

$$L_n = \frac{Z_{hi} len_n}{C} + \frac{Z_{low} len_{n-1}}{2C} + \frac{Z_{low} len_{n+1}}{2C} \quad (6)$$

In each of the equations, if the inductance is fixed (in the left side) and the axial length is reduced, then the impedance $Z_{hi}$ increases.

Impedance Z of a coaxial-line filter which includes an inner conductor portion having axial diameter w, and an outer conductor having inner diameter Φ is given by the following expression:

$$Z_{hi,low} = \frac{60}{\sqrt{\varepsilon_r}}\ln\left(\frac{\Phi}{w}\right) \quad (7)$$

where $\in_r$ denotes the relative dielectric constant in a space defined between the inner conductor portion and the outer conductor.

From equation (7), since impedance $Z_{hi}$ increases when the inner diameter Φ of the outer conductor is uniform, the axial diameter w of the inner conductor portion must be reduced. Meanwhile, as shown in FIG. 1, the inner diameter Φ of the outer conductor 1 increases (from $\Phi_a$ to $\Phi_b$), whereby it is only required to slightly change the axial diameter of the inner conductor portions in order to make constant impedance $Z_{hi}$ constant. Therefore, the axial diameter w of the inner conductor portion may not be reduced more than necessary. This ensures that the dimensions of a low-pass filter are sufficient for manufacturing. If the inner diameter Φ of the outer conductor increases to a predetermined size, it is not necessary to change the width w of the high-impedance portions in the inner conductor. Therefore, in the low-pass filter, the high-impedance portions can have different axial lengths and an equal axial diameter.

Accordingly, spurious resonance occurs at different frequencies, which does not affect an attenuation characteristic. Furthermore, the minimum axial diameter of an inner conductor sufficient to form the inner conductor can be ensured, thus preventing failure of manufacturing.

A low-pass filter according to a second embodiment of the present invention is now described with reference to FIG. 2.

Figure 2:
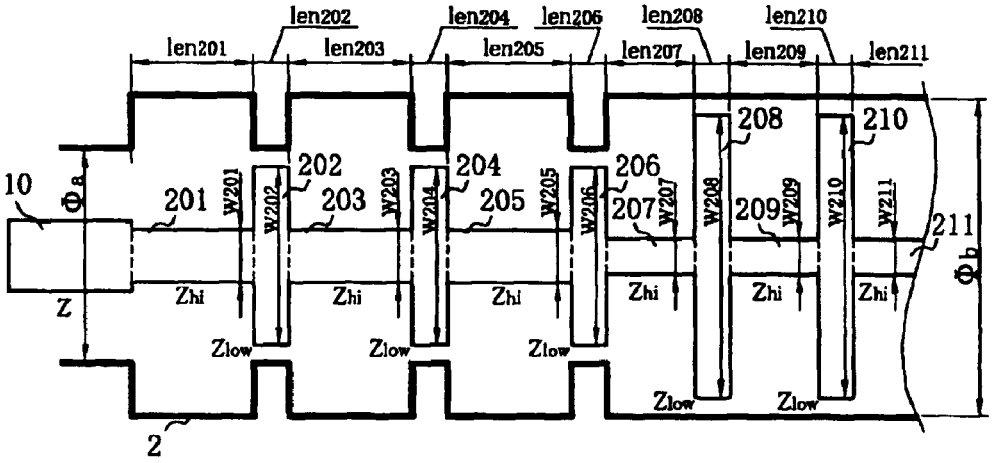
FIG. 2 is a side cross-sectional view of a low-pass filter according to a second embodiment of the present invention.

FIG. 2 is a side cross-sectional view of a low-pass filter according to the second embodiment.

The low-pass filter shown in FIG. 2 includes an outer conductor 2, an input/output unit 10, and an inner conductor formed within the outer conductor 2. The inner conductor is formed of inner conductor portions 201, 203, 205, 207, 209, and 211 which form high-impedance portions, and inner conductor portions 202, 204, 206, 208, and 210 which form low-impedance portions.

In FIG. 2, Z indicates input impedance of the input/output unit 10; $Z_{hi}$ indicates characteristic impedance of the inner conductor portions 201, 203, 205, 207, 209, and 211; $Z_{low}$ indicates characteristic impedance of the inner conductor portions 202, 204, 206, 208, and 210; len201 to len211 indicate the axial length of the inner conductor portions 201 to 211; w201 to w211 indicate the axial diameter of the inner conductor portions 201 to 211; and $\Phi_a$ and $\Phi_b$ indicate the inner diameter of the outer conductor 2.

In FIG. 2, the axial diameters w201, w203, and w205 of the inner conductor portions 201, 203, and 205 are greater than the axial diameters w207, w209, and w211 of the inner conductor portions 207, 209, and 211. In the outer conductor 2, the inner diameter $\Phi_b$ varies in portions corresponding to the inner conductor portions 201, 203, and 205 so as to provide irregularities. The remaining portions of the low-pass filter shown in FIG. 2 have the same structure as that of the low-pass filter shown in FIG. 1.

In this structure, the inner conductor portions 201, 203, 205, 207, 209, and 211 which form the high-impedance portions have different axial lengths len201, len203, len205, len207, len209, and len211. The inner conductor is therefore configured without the axial diameter reduced. A coaxial-line low-pass filter with excellent spurious characteristics is thus achieved with ease.

In order to produce a low-pass filter which includes an outer conductor having such irregularities, preferably, the outer conductor is first formed in a case such as an aluminum die-cast case which receives the low-pass filter, and an inner conductor is then inserted into the outer conductor. This technique enables a low-pass filter to be more easily produced.

A low-pass filter according to a third embodiment of the present invention is now described with reference to FIG. 3.

Figure 3:
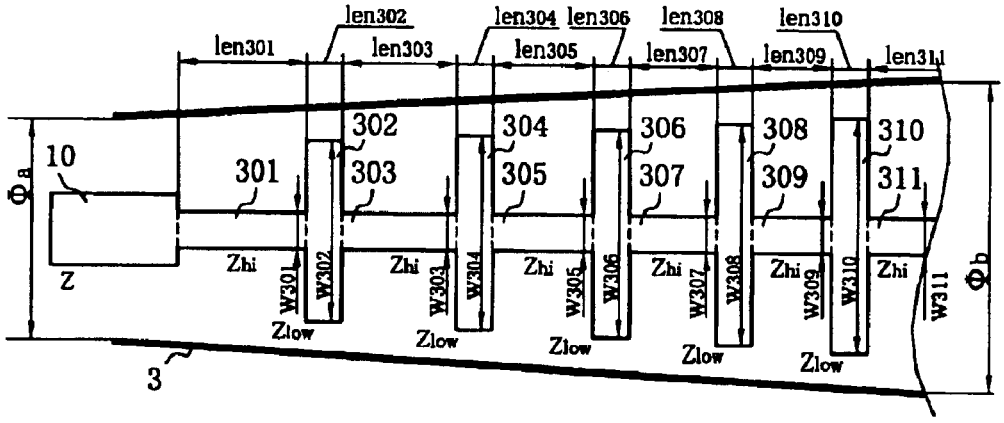
FIG. 3 is a side cross-sectional view of a low-pass filter according to a third embodiment of the present invention.

FIG. 3 is a side cross-sectional view of a low-pass filter according to the third embodiment.

The low-pass filter shown in FIG. 3 includes an outer conductor 3, an input/output unit 10, and an inner conductor formed within the outer conductor 3. The inner conductor is formed of inner conductor portions 301, 303, 305, 307, 309, and 311 which form high-impedance portions, and inner conductor portions 302, 304, 306, 308, and 310 which form low-impedance portions.

In FIG. 3, Z indicates input impedance of the input/output unit 10; $Z_{hi}$ indicates characteristic impedance of the inner conductor portions 301, 303, 305, 307, 309, and 311; $Z_{low}$ indicates characteristic impedance of the inner conductor portions 302, 304, 306, 308, and 310; len301 to len311 indicate the axial length of the inner conductor portions 301 to 311; w301 to w311 indicate the axial diameter of the inner conductor portions 301 to 311; and $\Phi_a$ and $\Phi_b$ indicate the inner diameter of the outer conductor 3.

The inner conductor is formed so that the inner conductor portions 301, 303, 305, 307, 309, and 311 forming the high-impedance portions, and the inner conductor portions 302, 304, 306, 308, and 310 forming the low-impedance portions are alternately connected with each other. The input/output unit 10 is connected to the inner conductor portion 301.

As shown in FIG. 3, in the outer conductor 3, the inner diameter of the outer conductor 3 linearly increases from a portion corresponding to the input/output unit 10, as indicated by $\Phi_a$, to a portion corresponding to the inner conductor portion 311, as indicated by $\Phi_b$. In this way, the interior surface of the outer conductor 3 is tapered.

Since the interior surface of the outer conductor 3 is tapered, the inner diameter of the outer conductor 3 is nonuniform at the positions of the inner conductor portions 301 to 311. Therefore, from equations (6) and (7) discussed with respect to the first embodiment, if the axial diameters w301, w303, w305, w307, w309, and w311 of the inner conductor portions 301, 303, 305, 307, 309, and 311 forming the high-impedance portions are the same, the axial lengths len301, len303, len305, len307, len309, and len311 of the inner conductor portions 301, 303, 305, 307, 309, and 311 can be different from one another. This allows spurious resonance to occur at different frequencies, thus preventing overlapping resonance peaks. A low-pass filter having excellent characteristics is thus achieved with ease.

Since the interior surface of the outer conductor 3 is tapered, the angled interior surface can be used as a die-pulling taper during manufacturing of the outer conductor 3. Therefore, the outer conductor 3 can be easily manufactured.

A low-pass filter according to a fourth embodiment of the present invention is now described with reference to FIG. 4.

Figure 4:
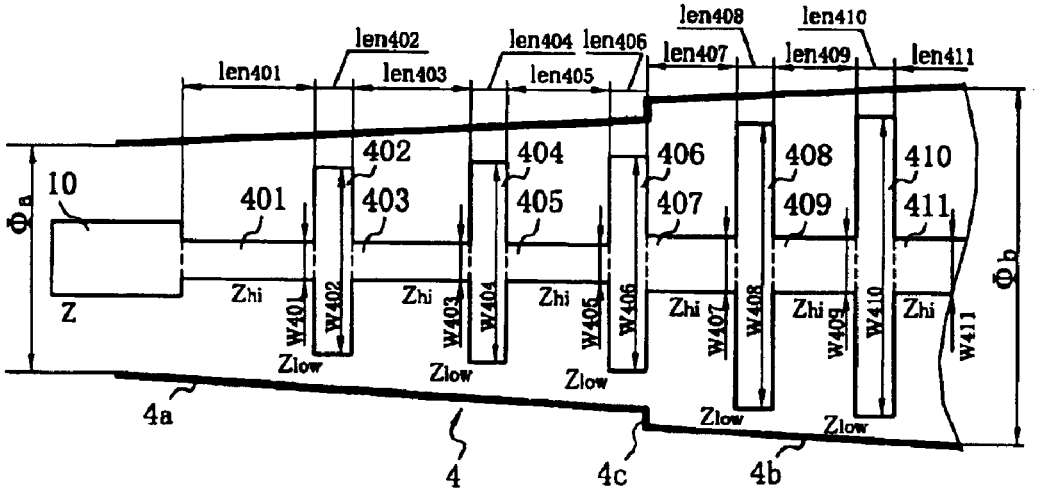
FIG. 4 is a side cross-sectional view of a low-pass filter according to a fourth embodiment of the present invention.

FIG. 4 is a side cross-sectional view of a low-pass filter according to the fourth embodiment.

The low-pass filter shown in FIG. 4 includes an outer conductor 4, an input/output unit 10, and an inner conductor formed within the outer conductor 4. The inner conductor is formed of inner conductor portions 401, 403, 405, 407, 409, and 411 which form high-impedance portions, and inner conductor portions 402, 404, 406, 408, and 410 which form low-impedance portions.

In FIG. 4, Z indicates input impedance of the input/output unit 10; $Z_{hi}$ indicates characteristic impedance of the inner conductor portions 401, 403, 405, 407, 409, and 411; $Z_{low}$ indicates characteristic impedance of the inner conductor portions 402, 404, 406, 408, and 410; len401 to len411 indicate the axial length of the inner conductor portions 401 to 411; w401 to w411 indicate the axial diameter of the inner conductor portions 401 to 411; and $\Phi_a$ and $\Phi_b$ indicate the inner diameter of the outer conductor 4.

The outer conductor 4 is formed of a first tapered portion 4*a*, a second tapered portion 4*b*, and a connecting portion 4*c* for connecting the first tapered portion 4*a* to the second tapered portion 4*b*. As shown in FIG. 4, the second tapered portion 4*b* has a greater inner diameter than that of the first tapered portion 4*a*. The connecting portion 4*c* preferably comprises a face vertical to the signal transmission direction. The inner diameter of the outer conductor 4 is indicated by $\Phi_a$ in a portion corresponding to the input/output unit 10, and is indicated by $\Phi_b$ in a portion corresponding to the inner conductor portion 411.

The inner conductor is formed so that the inner conductor portions 401, 403, 405, 407, 409, and 411 forming the high-impedance portions, and the inner conductor portions 402, 404, 406, 408, and 410 forming the low-impedance portions are alternately connected with each other. The input/output unit 10 is connected to the inner conductor portion 401. The connecting portion 4*c* of the outer conductor 4 is shown as being provided at a position corresponding to a connection between the inner conductor portions 406 and 407.

Since the interior surface of the outer conductor 4 is stepped and tapered, as in the third embodiment, the inner diameter of the outer conductor 4 is nonuniform at the positions of the inner conductor portions 401 to 411. In the first tapered portion 4*a*, therefore, from equations (6) and (7) discussed with respect to the first embodiment, if the axial diameters w401, w403, and w405 of the inner conductor portions 401, 403, and 405 forming the high-impedance portions are the same, the axial lengths len401, len403, and len405 of the inner conductor portions 401, 403, and 405 can be different from one another.

In the second tapered portion 4*b*, likewise, if the axial diameters w407, w409, and w411 of the inner conductor portions 407, 409, and 411 forming the high-impedance portions are the same, the axial lengths len407, len409, and len411 of the inner conductor portions 407, 409, and 411 can be different from one another.

In the third embodiment, the outer conductor 3 is tapered at a predetermined angle; whereas, in the fourth embodiment, the outer conductor 4 has a stepped portion (4*c*), and the inner diameter of the second tapered portion 4*b* is wholly greater than that of the first tapered portion 4*a*. Then, the axial diameters w407 to w411 of the inner conductor portions 407 to 411 in the fourth embodiment can be greater than the axial diameters w307 to w311 of the inner conductor portions 307 to 311 in the third embodiment. This allows the axial diameters w407, w409, and w411 of the inner conductor portions 407, 409, and 411 forming the high-impedance portions to be greater than the axial diameters w401, w403, and w405 of the inner conductor portions 401, 403, and 405 forming the other high-impedance portions.

Accordingly, the axial lengths of inner conductor portions forming high-impendence portions can differ from one another, and some of the inner conductor portions can have greater axial diameters, resulting in higher anti-vibration or anti-shock properties.

Since the interior surface of the outer conductor 4 is tapered, this angled interior surface can be used as a die-pulling taper during manufacturing of the outer conductor 4. Therefore, the outer conductor 4 can be easily manufactured.

In general, an outer conductor formed by combining two tapered portions would be more flexible in inner diameter design than an outer conductor formed of a single tapered portion. Therefore, the low-pass filter in the fourth embodiment can have a higher flexibility for designing the configuration of the high-impedance portions in the inner conductor than the low-pass filter in the third embodiment.

Although the outer conductor 4 is formed of two different tapered portions in the fourth embodiment, the present invention is not limited to this form, and an outer conductor formed of more than two different tapered portions may be used.

A low-pass filter according to a fifth embodiment of the present invention is now described with reference to FIGS. 5A and 5B.

Figure 5A:
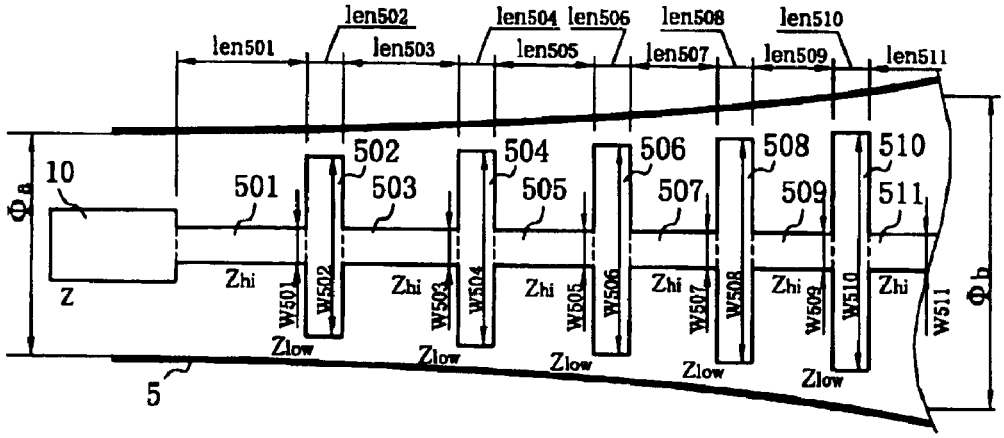
FIGS. 5A and 5B are side cross-sectional views of a low-pass filter according to a fifth embodiment of the present invention.
Figure 5B:
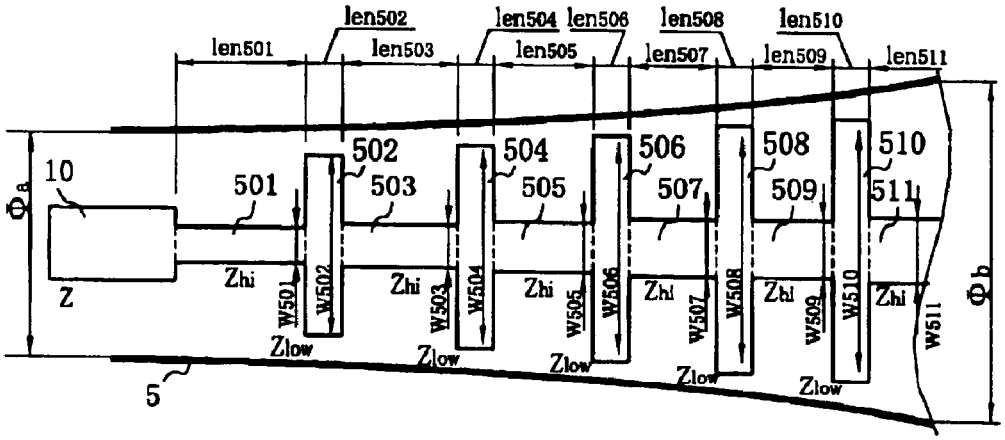

FIG. 5A is a side cross-sectional view of a low-pass filter in which inner conductor portions forming high-impedance portions have the same axial diameter, and FIG. 5B is a side cross-sectional view of a low-pass filter in which inner conductor portions forming high-impedance portions have different axial diameters.

In FIGS. 5A and 5B, the low-pass filter includes an outer conductor 5, an input/output unit 10, and an inner conductor formed within the outer conductor 5. The inner conductor is formed of inner conductor portions 501, 503, 505, 507, 509, and 511 which form high-impedance portions, and inner conductor portions 502, 504, 506, 508, and 510 which form low-impedance portions.

In FIGS. 5A and 5B, Z indicates input impedance of the input/output unit 10; $Z_{hi}$ indicates characteristic impedance of the inner conductor portions 501, 503, 505, 507, 509, and 511; $Z_{low}$ indicates characteristic impedance of the inner conductor portions 502, 504, 506, 508, and 510; len501 to len511 indicate the axial length of the inner conductor portions 501 to 511; w501 to w511 indicate the axial diameter of the inner conductor portions 501 to 511; and $\Phi_a$ and $\Phi_b$ indicate the inner diameter of the outer conductor 5.

The low-pass filter shown in FIG. 5A is configured so that the outer conductor 5 is tapered so as to nonlinearly change the inner diameter of the outer conductor 5 from a portion corresponding to the input/output unit 10, as indicated by $\Phi_a$, to a portion corresponding to the inner conductor portion 511, as indicated by $\Phi_b$. The remaining portions of the low-pass filter shown in FIG. 5A have the same structure as that of the low-pass filter shown in FIG. 3.

In this structure, as in the third embodiment, the axial lengths len501, len503, len505, len507, len509, and len511 of the inner conductor portions 501, 503, 505, 507, 509, and 511 forming the high-impedance portions can differ from one another. Furthermore, the angled interior surface of the outer conductor 5 can be used as a die-pulling taper during manufacturing of the outer conductor 5, and the outer conductor 5 can be easily manufactured.

In the low-pass filter shown in FIG. 5B, as the inner diameter of the outer conductor 5 changes, the axial diameters w501 to w511 of the inner conductor portions 501 to 511 preferably increasingly change in proportion. This structure provides higher anti-vibration and anti-shock properties of the low-pass filter.

It is anticipated that this structure can also be applied to the third embodiment.

A low-pass filter according to a sixth embodiment of the present invention is now described with reference to FIG. 6.

Figure 6:
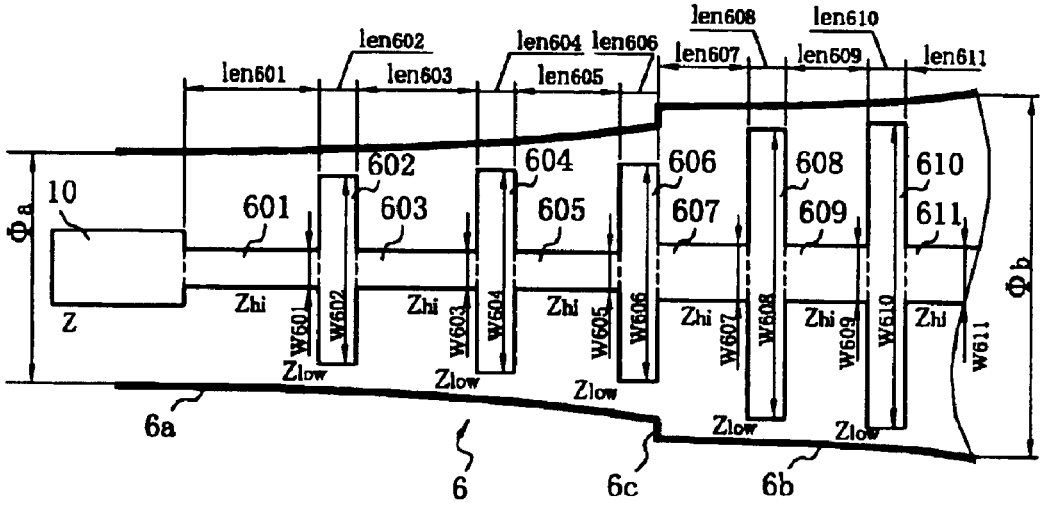
FIG. 6 is a side cross-sectional view of a low-pass filter according to a sixth embodiment of the present invention.
Figure 7:
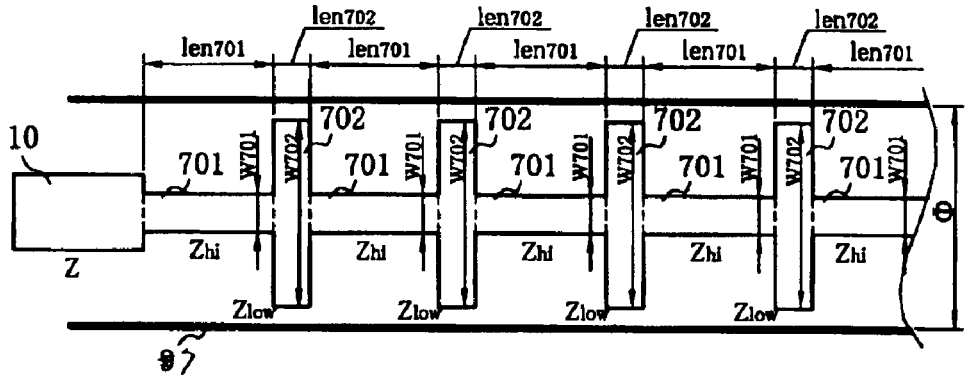
FIG. 7 PRIOR ART
FIG. 7 is a side cross-sectional view of a low-pass filter in the related art.

FIG. 6 is a side cross-sectional view of a low-pass filter according to the sixth embodiment.

The low-pass filter shown in FIG. 6 includes an outer conductor 6, an input/output unit 10, and an inner conductor formed within the outer conductor 6. The inner conductor is formed of inner conductor portions 601, 603, 605, 607, 609, and 611 which form high-impedance portions, and inner conductor portions 602, 604, 606, 608, and 610 which form low-impedance portions. The outer conductor 6 is formed of a first tapered portion 6*a*, a second tapered portion 6*b*, and a connecting portion 6*c* for connecting the first tapered portion 6*a* to the second tapered portion 6*b*.

In FIG. 6, Z indicates input impedance of the input/output unit 10; $Z_{hi}$ indicates characteristic impedance of the inner conductor portions 601, 603, 605, 607, 609, and 611; $Z_{low}$ indicates characteristic impedance of the inner conductor portions 602, 604, 606, 608, and 610; len601 to len611 indicate the axial length of the inner conductor portions 601 to 611; w601 to w611 indicate the axial diameter of the inner conductor portions 601 to 611; and $\Phi_a$ and $\Phi_b$ indicate the inner diameter of the outer conductor 6.

In the low-pass filter shown in FIG. 6, the outer conductor 6 is formed of the first and second tapered portions 6*a* and 6*b* so that the inner diameter of the first tapered portion 6*a* nonlinearly increases from a portion corresponding to the input/output unit 10 to a portion corresponding to the connecting portion 6*c*, and the inner diameter of the second tapered portion 6*b* nonlinearly increases from a portion corresponding to the connecting portion 6*c* to a portion corresponding to inner conductor portion 611. The inner diameter of the outer conductor 6 is indicated by $\Phi_a$ in a portion corresponding to the input/output unit 10, and indicated by $\Phi_b$ in a portion corresponding to the inner conductor portion 611. The remaining portions of the low-pass filter shown in FIG. 6 have the same structure as that of the low-pass filter shown in FIG. 4.

In this structure, as in the fourth embodiment, the axial lengths len601, len603, len605, len607, len609, and len611 of the inner conductor portions 601, 603, 605, 607, 609, and 611 forming the high-impendence portions can differ from one another. Furthermore, the angled interior surface of the outer conductor 6 can be used as a die-pulling taper, and the outer conductor 6 can easily manufactured. A filter having high anti-vibration and anti-shock properties can be achieved.

In the foregoing embodiments, each of the inner conductor portions is shown as having a cylindrical shape; however, the present invention is not limited to this form, and each inner conductor portion may have an elliptic or polygonal cross-section as far as required impedance is obtained.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A low-pass filter comprising:

an outer conductor having a predetermined shape in a cross section perpendicular to a signal propagation direction;

an inner conductor formed within the outer conductor, the inner conductor including a plurality of low-impedance portions and a plurality of high-impedance portions arranged in an alternate manner; and an input/output unit connected to an end of the inner conductor, wherein the cross section of the outer conductor perpendicular to the signal propagation direction is nonuniform in the signal propagation direction, and wherein at least two high-impedance portions of the plurality of high-impedance portions have different axial lengths in the signal propagation direction.

2. The low-pass filter according to claim 1, wherein a predetermined high-impedance portion of the plurality of high-impedance portions in the inner conductor is different from the other high-impedance portions in one of shape and area of a plane perpendicular to the signal propagation direction.

3. The low-pass filter according to claim 2, wherein the outer conductor is tapered so that an interior surface of the outer conductor does not extend straight in a view of the outer conductor taken along a plane perpendicular to the signal propagation direction.

4. The low-pass filter according to claim 3, wherein the outer conductor includes a portion in which the inner diameter of the outer conductor is nonuniform in the signal propagation direction.

5. The low pass filter according to claim 1, wherein a predetermined low-impedance portion of the plurality of low-impedance portions in the inner conductor is different from the other low-impedance portions in one of shape and area in a plane perpendicular to the signal propagation direction and in length in the signal propagation direction.

6. The low-pass filter according to claim 5, wherein a predetermined high-impedance portion of the plurality of high-impedance portions in the inner conductor is different from the other high-impedance portions in one of shape and area in a plane perpendicular to the signal propagation direction.

7. The low-pass filter according to claim 1, wherein the outer conductor is tapered so that an interior surface of the outer conductor does not extend straight in a view of the outer conductor taken along a plane perpendicular to the signal propagation direction.

8. The low-pass filter according to claim 7, wherein the outer conductor includes a portion in which the inner diameter of the outer conductor is nonuniform in the signal propagation direction.

9. The low-pass filter according to claim 1, wherein the outer conductor is shaped so that an interior surface of the outer conductor is formed of at least two curved portions, and at least one straight portion connecting the at least two curved portions with each other.

10. A low-pass filter comprising:

an outer conductor having a predetermined shape in a cross section perpendicular to a signal propagation direction;

an inner conductor formed within the outer conductors the inner conductor including a plurality of low-impedance portions and a plurality of high-impedance portions arranged in an alternate manner; and an input/output unit connected to an end of the inner conductor, wherein the cross section of the outer conductor perpendicular to the signal propagation direction is nonuniform in the signal propagation direction, and wherein the outer conductor is shaped so that an interior surface of the outer conductor extends in a curved manner in a view of the outer conductor taken along a plane perpendicular to the signal propagation direction.

11. The low-pass filter according to claim 10, wherein the outer conductor includes a portion in which the inner diameter of the outer conductor is nonuniform in the signal propagation direction.

12. A low-pass filter comprising:

an outer conductor having a predetermined shape in a cross section perpendicular to a signal propagation direction;

an inner conductor formed within the outer conductor, the inner conductor including a plurality of low-impedance portions and a plurality of high-impedance portions arranged in an alternate manner; and an input/output unit connected to an end of the inner conductor, wherein the cross section of the outer conductor perpendicular to the signal propagation direction is nonuniform in the signal propagation direction, wherein a predetermined high-impedance portion of the plurality of high-impedance portions in the inner conductor is different from the other high-impedance portions in one of shape and area of a plane perpendicular to the signal propagation direction and in length in the signal propagation direction, and wherein the outer conductor is shaped so that an interior surface of the outer conductor extends in a curved manner in a view of the outer conductor taken along a plane perpendicular to the signal propagation direction.

13. The low-pass filter according to claim 12, wherein the outer conductor includes a portion in which the inner diameter of the outer conductor is nonuniform in the signal propagation direction.

14. A low-pass filter comprising:

an outer conductor having a predetermined shape in a cross section perpendicular to a signal propagation direction;

an inner conductor formed within the outer conductor, the inner conductor including a plurality of low-impedance portions and a plurality of high-impedance portions arranged in an alternate manner; and an input/output unit connected to an end of the inner conductor, wherein the cross section of the outer conductor perpendicular to the signal propagation direction is nonuniform in the signal propagation direction, wherein a predetermined high-impedance portion of the plurality of high-impedance portions in the inner conductor is different from the other high-impedance portions in one of shape and area of a plane perpendicular to the signal propagation direction and in length in the signal propagation direction, and wherein the outer conductor is shaped so that an interior surface of the outer conductor is formed of at least two curved portions, and at least one straight portion connecting the at least two curved portions with each other.

* * * * *